US008941571B2

(12) United States Patent
Katagiri et al.

(10) Patent No.: US 8,941,571 B2
(45) Date of Patent: Jan. 27, 2015

(54) LIQUID CRYSTAL DRIVING CIRCUIT

(75) Inventors: Norikazu Katagiri, Gunma-ken (JP); Tetsuya Tokunaga, Gunma-ken (JP); Tomoshi Yoshida, Hyogo-ken (JP); Kensuke Goto, Tochigi-ken (JP); Mamoru Yamaguchi, Gunma-ken (JP)

(73) Assignee: Semiconductor Components Industries, LLC, Phoenix, AZ (US)

( * ) Notice: Subject to any disclaimer, the term of this patent is extended or adjusted under 35 U.S.C. 154(b) by 158 days.

(21) Appl. No.: 13/584,397

(22) Filed: Aug. 13, 2012

(65) Prior Publication Data

US 2013/0038805 A1 Feb. 14, 2013

(30) Foreign Application Priority Data

Aug. 12, 2011 (JP) ..... 2011-176883

(51) Int. Cl.
*G09G 3/36* (2006.01)
*G09G 3/04* (2006.01)

(52) U.S. Cl.
CPC ..... *G09G 3/3655* (2013.01); *G09G 3/3696* (2013.01); *G09G 3/04* (2013.01); *G09G 3/3614* (2013.01); *G09G 2330/025* (2013.01)
USPC ..... 345/87

(58) Field of Classification Search
None
See application file for complete search history.

(56) References Cited

U.S. PATENT DOCUMENTS

2010/0103157 A1* 4/2010 Goto et al. ..... 345/211
2011/0242145 A1* 10/2011 Nishimura et al. ..... 345/690

FOREIGN PATENT DOCUMENTS

JP 10-010491 A 1/1998

OTHER PUBLICATIONS

Patent Abstracts of Japan, Publication No. 10-010491, Published on Jan. 16, 1998, 1 page.

* cited by examiner

*Primary Examiner* — Joseph Haley
(74) *Attorney, Agent, or Firm* — Rennie William Dover

(57) ABSTRACT

A liquid-crystal-driving circuit includes: resistors connected in series between first and second potentials lower than the first potential; one or more voltage follower circuits to impedance-convert one or more intermediate potentials between the first and second potentials, to be outputted, respectively, the intermediate potentials generated at one or more connection points between the resistors, respectively; a common-signal-output circuit to supply common signals to common electrodes of a liquid crystal panel, respectively, the common signals being at the first, second, or one or more intermediate potentials in a predetermined order; and a segment-signal output circuit supplies segment signals to segment electrodes of the liquid crystal panel, respectively, the segment signals being at the first and second potentials, or the intermediate potentials according to the common signals, wherein the segment-signal output circuit increases impedances of the segment signals only for a first period when the of segment signals potentials are switched.

17 Claims, 13 Drawing Sheets

LIQUID CRYSTAL DRIVING CIRCUIT

CROSS-REFERENCE TO RELATED APPLICATION

This application claims the benefit of priority to Japanese Patent Application No. 2011-176883, filed Aug. 12, 2011, of which full contents are incorporated herein by reference.

BACKGROUND OF THE INVENTION

1. Field of the Invention

The present invention relates to a liquid crystal driving circuit.

2. Description of the Related Art

In a segment-display type or a simple matrix driving type liquid crystal panel, a common signal and a segment signal are supplied to a common electrode and a segment electrode, respectively, and on/off controlled in accordance with a voltage (potential difference) between two electrodes, in general.

In these liquid crystal panels, performing time-division driving enables display of more segments (pixels) than the number of output terminals of an IC for driving a liquid crystal. For example, in a liquid crystal panel with m numbers of common electrodes and n numbers of segment electrodes, performing 1/m duty cycle driving enables displaying m×n segments at maximum. Further, in time-division driving, 1/S bias driving is performed so that each signal can obtain (S+1) potentials. For example, in FIG. 4 of Japanese Patent Laid-Open Publication No. H10-10491, disclosed is an LCD driving power circuit used for ⅓ bias driving.

Here, a configuration of a common liquid crystal driving circuit that performs time-division driving and an example of an operation thereof are illustrated in FIGS. 10 and 11, respectively.

As illustrated in FIG. 10, intermediate potentials V1 and V2 obtained by dividing a power supply voltage V0 (=VDD−VSS) by resistors R1 to R3 are supplied, in addition to power supply potentials VDD and VSS on a high-potential side and a low-potential side, to a common-signal output circuit 7 and a segment-signal output circuit 8. Therefore, in this liquid crystal driving circuit, ⅓ bias driving (S=3) is performed.

Further, FIG. 11 illustrates an operation of the liquid crystal driving circuit that performs ¼ duty cycle driving (m=4). As illustrated in FIG. 11, the potential of a common signal COMi ($1 \le i \le m$), during a single period T1, is at the power supply potential VDD or VSS for a ¼ period and at the intermediate potential V1 or V2 for a ¾ period. On the other hand, segment signals SEGj and SEGj' ($1 \le j, j' \le n$) are at potentials according to turning on or off of four segments corresponding to segment electrodes to which the signals are supplied.

As described above, use of the 1/m duty cycle and 1/S bias driving method enables displaying more segments than the number of output terminals of the IC for driving a liquid crystal.

The common electrode to which the common signal COMi is supplied and the segment electrode to which the segment signal SEGj is supplied are capacitively-coupled through liquid crystal, and thus, beard-like spike noise might be generated in one of the signals, which is caused by change in potential of the other of the signals. Thus, in the liquid crystal driving circuit illustrated in FIG. 10, similar to FIG. 4 in Japanese Patent Laid-Open Publication No. H10-10491, capacitors C1 and C2 are used as stabilizing capacitors so as to absorb the spike noise and to stabilize the intermediate potentials V1 and V2. As illustrated in FIG. 12, such a liquid crystal driving circuit is known that stabilizes the intermediate potentials V1 and V2 using voltage follower circuits configured by operational amplifiers OP1 and OP2, respectively.

However, since the capacitance of the capacitor used as the stabilizing capacitor is large in accordance with the liquid crystal panel, the capacitor is usually provided as an external component, which increases the mounting area of a circuit board. On the other hand, since the output impedance of the operational amplifier which makes up the voltage follower circuit is small, current consumption increases.

Further, if the output impedance of the operational amplifier is not sufficiently small, as illustrated in FIGS. 13 and 14, spike noise Sp is not sufficiently absorbed, which might cause a defective display such as an image remaining in the liquid crystal panel. Here, as an example, FIG. 13 illustrates spike noise Sp generated when the potential of the common signal COM1 is switched while the potential of the segment signal SEGj is at the intermediate potential. Whereas, FIG. 14 illustrates spike noise Sp generated when the potential of the segment signal SEGj' is switched while the potential of the common signal COM1 is at the intermediate potential.

Thus, in order to ensure favorable display quality, the current consumption of the liquid crystal driving circuit and the mounting area of the circuit board are in a trade-off relationship.

SUMMARY OF THE INVENTION

A liquid crystal driving circuit according to an aspect of the present invention, includes: a plurality of resistors connected in series between a first potential and a second potential lower than the first potential; one or more voltage follower circuits configured to impedance-convert one or more intermediate potentials between the first potential and the second potential, to be outputted, respectively, the one or more intermediate potentials generated at one or more connection points between the plurality of resistors, respectively; a common-signal output circuit configured to supply common signals to common electrodes of a liquid crystal panel, respectively, each of the common signals being at the first potential, the second potential, or the one or more intermediate potentials in a predetermined order; and a segment-signal output circuit configured to supply segment signals to segment electrodes of the liquid crystal panel, respectively, each of the segment signals being at the first potential, the second potential, or the one or more intermediate potentials in accordance with the common signals, wherein the segment-signal output circuit is further configured to increase impedances of the segment signals only for a first period in a case where the potentials of the segment signals are switched.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

Outline of Configuration of Entire Liquid Crystal Driving Circuit

An outline of a configuration of an entire liquid crystal driving circuit according to an embodiment of the present invention will hereinafter be described referring to FIG. 2.

Figure 2:
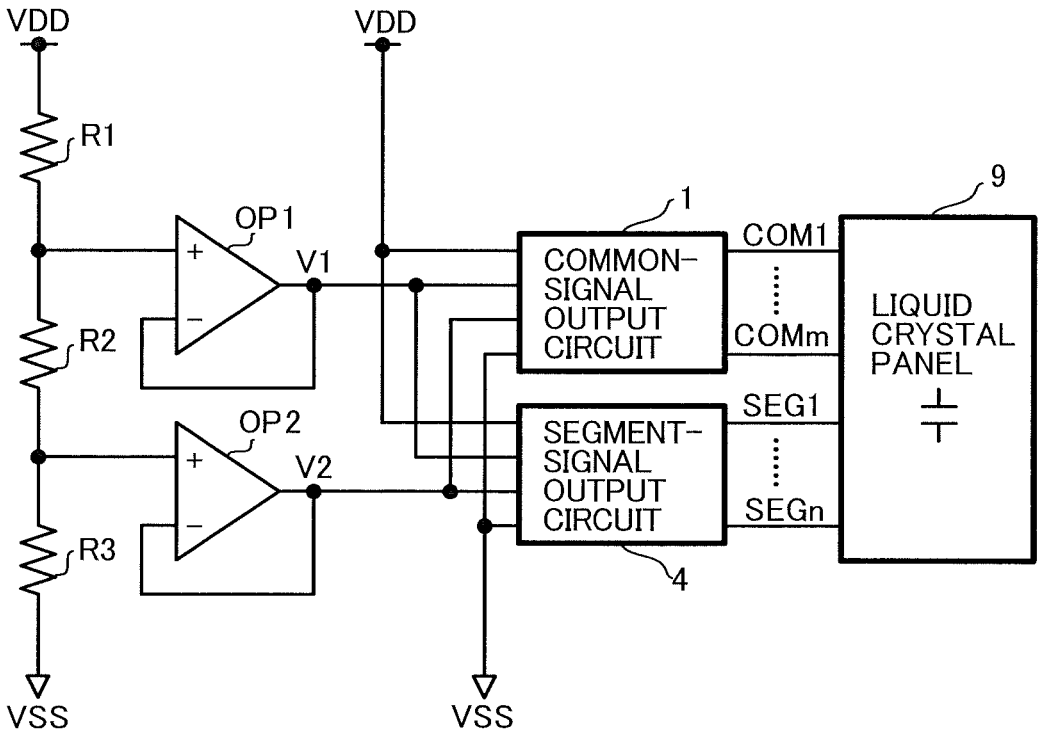
FIG. 2 is a circuit block diagram illustrating an outline of a configuration of an entire liquid crystal driving circuit according to an embodiment of the present invention.

The liquid crystal driving circuit illustrated in FIG. 2 is a circuit configured to drive a liquid crystal panel 9 and includes resistors R1 to R3, operational amplifiers OP1 and OP2, a common-signal output circuit 1, and a segment-signal output circuit 4.

The resistors R1 to R3 are connected in series in this order. One end of the resistor R1 is connected to a power supply potential VDD (first potential) on a high potential side, while one end of the resistor R3 is connected to a power supply potential VSS (second potential) on a low potential side.

The operational amplifier OP1 has a non-inverting input connected to a connection point between the resistors R1 and R2, and an inverting input and an output connected to each other, thereby making up a voltage follower circuit. The operational amplifier OP2 has a non-inverting input connected to a connection point between the resistors R2 and R3, and an inverting input and an output connected to each other, thereby making up a voltage follower circuit.

The power supply potentials VDD and VSS and the intermediate potentials V1 and V2 respectively outputted from the operational amplifiers OP1 and OP2 are supplied to both of the common-signal output circuit 1 and the segment-signal output circuit 4. Common signals COM1 to COMm outputted from the common-signal output circuit 1 are supplied to m common electrodes (not shown) of the liquid crystal panel 9, respectively. On the other hand, segment signals SEG1 to SEGn outputted from the segment-signal output circuit 4 are supplied to n segment electrodes (not shown) of the liquid crystal panel 9, respectively.

Figure 1:
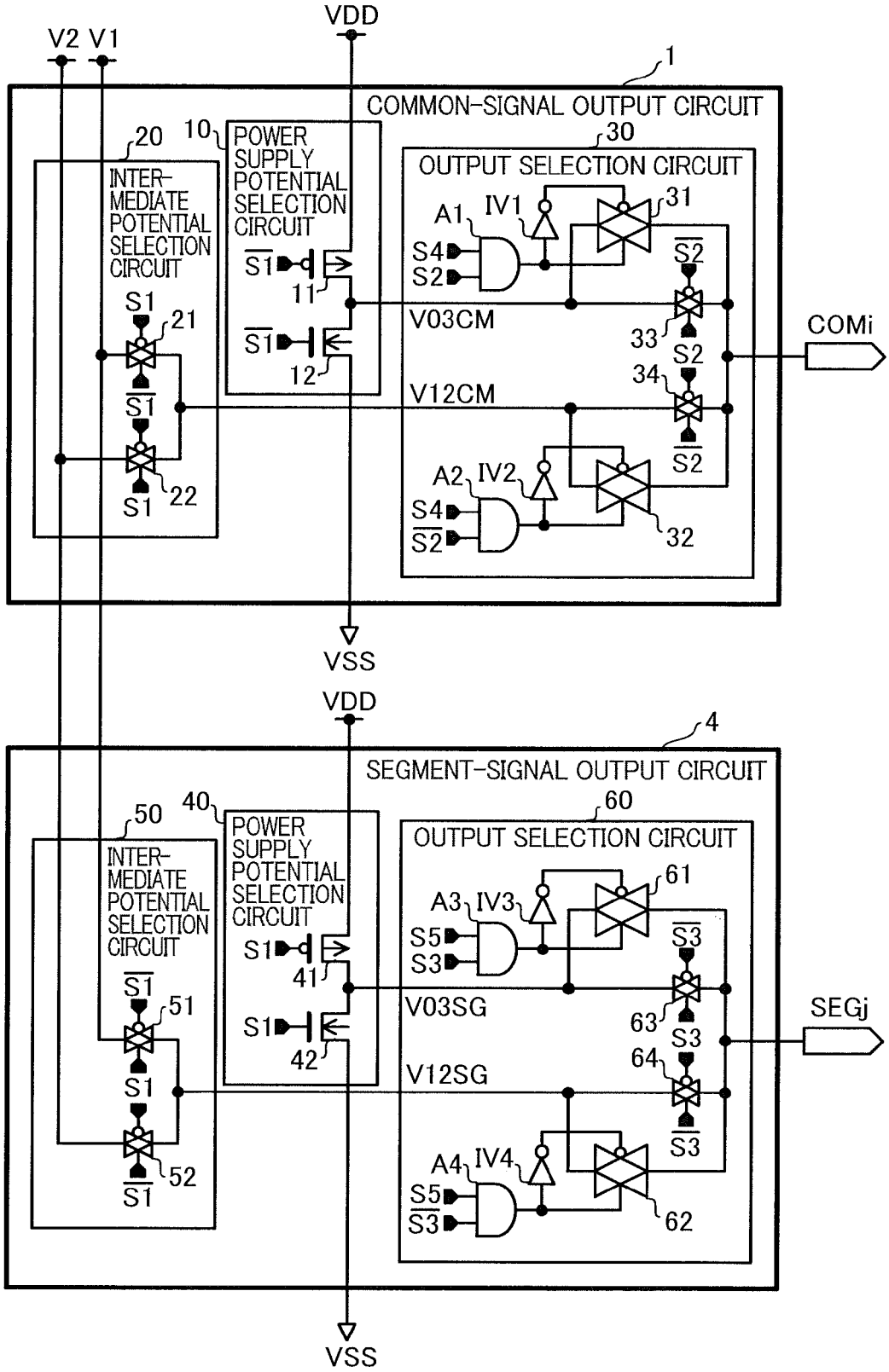
FIG. 1 is a circuit block diagram illustrating an example of specific configurations of a common-signal output circuit 1 and a segment-signal output circuit 4.

Configurations of Common-Signal Output Circuit and Segment-Signal Output Circuit More specific configurations of the common-signal output circuit 1 and the segment-signal output circuit 4 will hereinafter be described referring to FIG. 1. FIG. 1 illustrates only one circuit configured to output an arbitrary common signal COMi ($1 \leq i \leq m$) among the common-signal output circuits 1, and only one circuit configured to output an arbitrary segment signal SEGj ($1 \leq j \leq n$) among the segment-signal output circuits 4.

The common-signal output circuit 1 includes a power-supply potential selection circuit 10, an intermediate potential selection circuit 20, and an output selection circuit 30.

The power-supply potential selection circuit 10 includes a PMOS (P-channel Metal-Oxide Semiconductor) transistor 11 and an NMOS (N-channel MOS) transistor 12.

Sources of the transistors 11 and 12 are connected to the power supply potentials VDD and VSS, respectively, and the drains are connected to each other. Moreover, an inverted signal of a clock signal S1 is inputted to gates of the transistors 11 and 12. And, a power supply potential signal V03CM is outputted from a connection point between the drains of the transistors 11 and 12.

The intermediate potential selection circuit 20 includes transmission gates (analog switches) 21 and 22.

One end of each the transmission gate 21 and 22 are connected to the intermediate potentials V1 and V2, respectively, while the other ends are connected to each other. Moreover, the clock signal S1 and its inverted signal are inputted as control signals to the transmission gates 21 and 22. And, an intermediate potential signal V12CM is outputted from a connection point between the other ends of the transmission gates 21 and 22. Note that, the transmission gate 21 is turned on while the clock signal S1 is at a low level, while the transmission gate 22 is turned on while the clock signal S1 is at a high level.

The output selection circuit 30 includes transmission gates 31 to 34, AND circuits (logical product circuit) A1 and A2, and inverters (inverting circuits) IV1 and IV2. Note that, the transmission gates 31 and 32 correspond to a first switch circuit (first transmission gate), while the transmission gates 33 and 34 correspond to a second switch circuit (second transmission gate). And the size of the transistor constituting the transmission gates 31 and 32 is larger than the size of the transistor constituting the transmission gates 33 and 34, one example being several tens of times larger.

A clock signal S2 and an edge detection signal S4 are inputted to the AND circuit A1, and an inverted signal of an output signal of the AND circuit A1 is outputted from the inverter IV1. Moreover, an inverted signal of the clock signal S2 and the edge detection signal S4 are inputted to the AND circuit A2 and an inverted signal of an output signal of the AND circuit A2 is outputted from the inverter IV2.

One end of each the transmission gate 31 and 32 has the power supply potential signal V03CM and the intermediate potential signal V12CM inputted thereto, respectively, while the other ends thereof are both connected to an output node of a common signal COMi. Moreover, the output signal of the AND circuit A1 and its inverted signal are inputted as control signals to the transmission gate 31, and the transmission gate 31 is turned on while in response to an output signal of the AND circuit A1 being at a high level. On the other hand, the output signal of the AND circuit A2 and its inverted signal are inputted as control signals to the transmission gate 32, and the transmission gate 32 is turned on in response to the output signal of the AND circuit A2 being at a high level.

The transmission gates 33 and 34 are connected in parallel with the transmission gates 31 and 32, respectively. Moreover, the clock signal S2 and its inverted signal are inputted as control signals to the transmission gates 33 and 34. The transmission gate 33 is turned on while the clock signal S2 is at a high level, and the transmission gate 34 is turned on while the clock signal S2 is at a low level.

The segment-signal output circuit 4 includes a power-supply potential selection circuit 40, an intermediate potential selection circuit 50, and an output selection circuit 60.

The power-supply potential selection circuit 40 includes a PMOS transistor 41 and an NMOS transistor 42.

Sources of the transistors 41 and 42 are connected to the power supply potentials VDD and VSS, respectively, while their drains are connected to each other. The clock signal 51 is inputted to the gates of both transistors 41 and 42. A power supply potential signal V03SG is outputted from a connection point between drains of the transistors 41 and 42.

The intermediate potential selection circuit 50 includes transmission gates 51 and 52.

One end of each the transmission gate 51 and 52 are connected to the intermediate potentials V1 and V2, respectively, while the other ends are connected to each other. The clock signal S1 and its inverted signal are inputted as control signals to the transmission gates 51 and 52. And an intermediate potential signal V12SG is outputted from a connection point between the other ends of the transmission gates 51 and 52. Note that the transmission gate 51 is turned on in response to the clock signal S1 being at a high level, and the transmission gate 52 is turned on in response to the clock signal S1 being at a low level.

The output selection circuit 60 includes transmission gates 61 to 64, AND circuits A3 and A4, and inverters IV3 and IV4. The transmission gates 61 and 62 correspond to a third switch circuit (third transmission gate), while the transmission gates 63 and 64 correspond to a fourth switch circuit (fourth transmission gate). Moreover, the size of the transistor constituting the transmission gates 61 and 62 is larger than the size of the transistor constituting the transmission gates 63 and 64, one example being several tens of times larger.

A clock signal S3 and an edge detection signal S5 are inputted to the AND circuit A3, and an inverted signal of an output signal of the AND circuit A3 is outputted from the inverter IV3. Moreover, an inverted signal of the clock signal S3 and the edge detection signal S5 are inputted to the AND circuit A4, while an inverted signal of the output signal of the AND circuit A4 is outputted from the inverter IV4.

One end of each the transmission gate 61 and 62 has the power supply potential signal V03SG and the intermediate potential signal V12SG inputted thereto, respectively, while the other ends thereof are both connected to an output node of the segment signal SEGj. Moreover, the output signal of the AND circuit A3 and its inverted signal are inputted as control signals to the transmission gate 61, and the transmission gate 61 is turned on in response to the output signal of the AND circuit A3 being at a high level. On the other hand, the output signal of the AND circuit A4 and its inverted signal are inputted as control signals to the transmission gate 62, and the transmission gate 62 is turned on in response to the output signal of the AND circuit A4 being at a high level.

The transmission gates 63 and 64 are connected in parallel with the transmission gates 61 and 62, respectively. Moreover, the clock signal S3 and its inverted signal are inputted as control signals to the transmission gates 63 and 64. Note that the transmission gate 63 is turned on while the clock signal S3 is at a high level, while the transmission gate 64 is turned on while the clock signal S3 is at a low level.

Operation of Liquid Crystal Driving Circuit

An operation of the liquid crystal driving circuit according to an embodiment of the present invention will hereinafter be described referring to FIGS. 1 to 4 as appropriate.

The resistors R1 to R3 divide the power supply voltage V0 (=VDD−VSS). The voltage follower circuit, configured with the operational amplifier OP1, impedance-converts and outputs the intermediate potential V1 generated at the connection point between the resistors R1 and R2. On the other hand, the voltage follower circuit, configured with the operational amplifier OP2, impedance-converts and outputs the intermediate potential V2 generated at the connection point between the resistors R2 and R3.

Note that as the resistors R1 to R3, those with equal resistance values are used in general. Therefore, VDD−V1=V1−V2=V2−VSS=⅓V0 is given, and the liquid crystal driving circuit performs ⅓ bias driving.

Here, referring to FIGS. 3 and 4, description will be given of an example of a specific operation of the common-signal output circuit 1 and the segment-signal output circuit 4 in the case where the liquid crystal driving circuit performs ¼ duty cycle driving (m=4).

Figure 3:
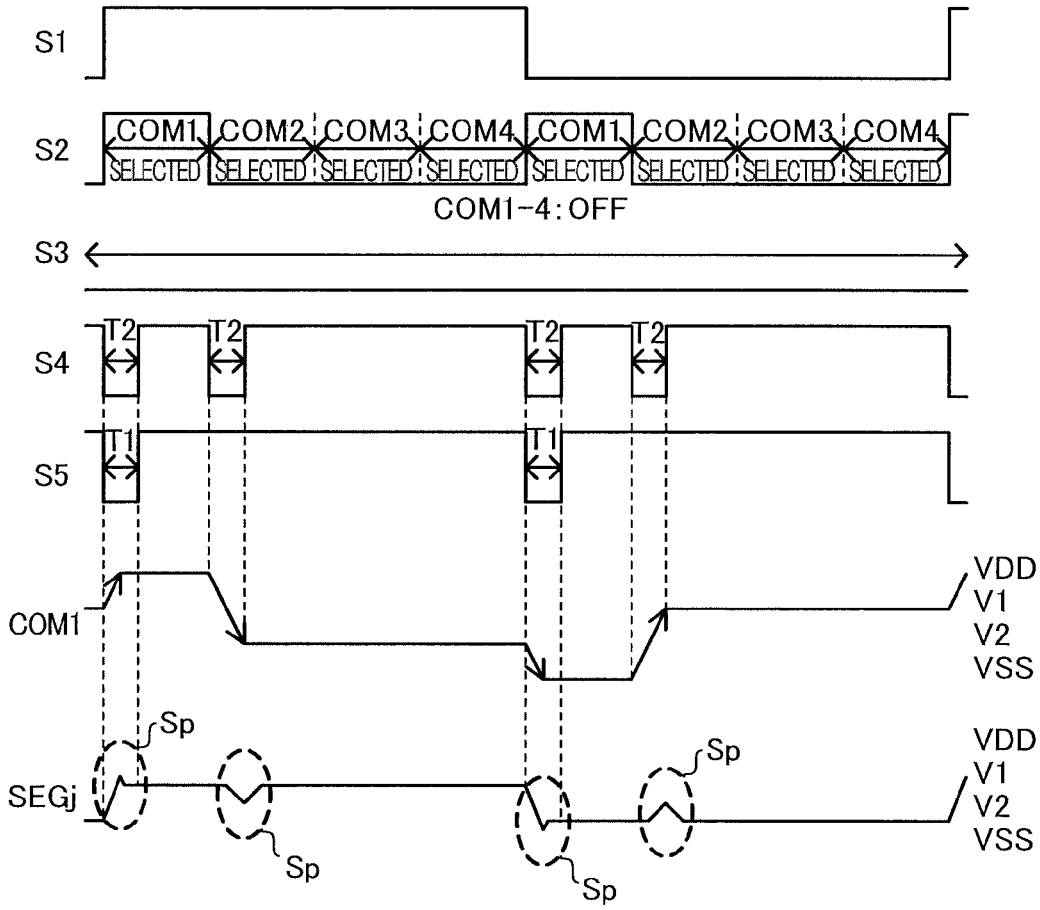
FIG. 3 is a diagram for explaining an operation of a liquid crystal driving circuit according to an embodiment of the present invention.

FIG. 3 illustrates an operation in the case where the common-signal output circuit 1 illustrated in FIG. 1 outputs the common signal COM1, and the segment-signal output circuit 4 also illustrated in FIG. 1 outputs the segment signal SEGj. Moreover, the segment signal SEGj is illustrated with a waveform when the four segments corresponding to the signal are all turned off.

Figure 4:
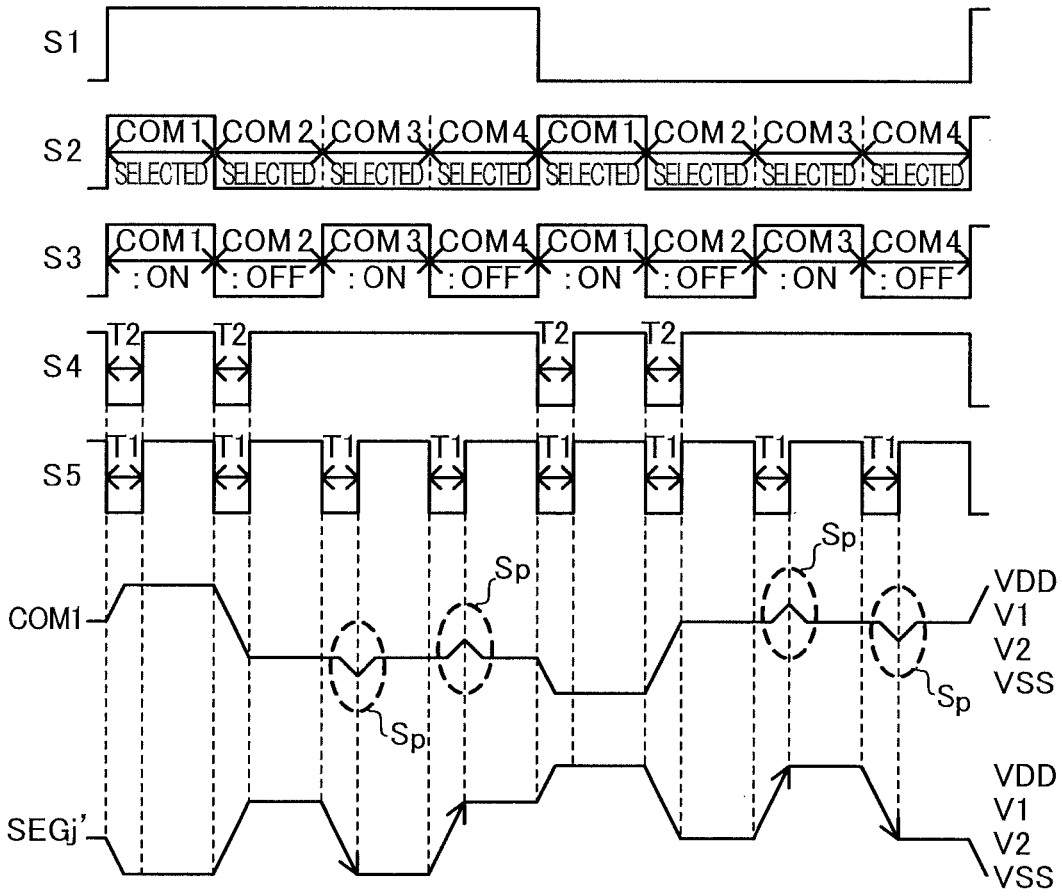
FIG. 4 is a diagram for explaining an operation of a liquid crystal driving circuit according to an embodiment of the present invention.

On the other hand, FIG. 4 illustrates an operation in the case where the common-signal output circuit 1 illustrated in FIG. 1 outputs the common signal COM1, and the segment-signal output circuit 4 also illustrated in FIG. 1 outputs the segment signal SEGj' (1≤j'≤n). Moreover, the segment signal SEGj' is illustrated with a waveform when among the four segments corresponding to the signals, two segments corresponding to the common signals COM1 and COM3 are turned on and two segments corresponding to the common signals COM2 and COM4 are turned off.

First, an operation of the common-signal output circuit 1 will be described.

The potential of the common signal COM1 outputted from the common-signal output circuit 1 is selected in accordance with the clock signals S1 and S2.

The clock signal S2 is a clock signal with ¼ duty cycle, and a high-level period (S2=H) of the signal indicates a time period during which n pieces of the segments corresponding to the common signal COM1 are selected. Therefore, in the case where the common-signal output circuit 1 outputs the common signals COM2 to COM4, the waveform of the clock signal S2 is shifted by ¼0 period each. Hereinafter, the time period (S2=H) during which n pieces of the segments corresponding to the common signal COMi are selected and the time period (S2=L) during which they are not selected will be referred to as a selection period and a non-selection period of the common signal COMi, respectively.

On the other hand, the clock signal S1 is a ½-duty cycle clock signal inverted each cycle of the clock signal S2, and each potential taken by the common signal COM1 in the selection period and the non-selection period is selected in accordance with the clock signal S1.

When the clock signal S1 is at high level, the transistor 11 is turned on and the transistor 12 off, and the potential of the power supply potential signal V03CM outputted from the power-supply potential selection circuit 10 is at the power supply potential VDD. Moreover, when the transmission gate 21 is turned off and the transmission gate 22 on, the potential of the intermediate potential signal V12CM outputted from the intermediate potential selection circuit 20 is at the intermediate potential V2.

And in this case, when the selection period (S2=H) of the common signal COM1 comes, the transmission gate 33 is turned on and the transmission gate 34 off, and the potential of the common signal COM1 outputted from the output selection circuit 30 is at the power supply potential VDD. On the other hand, when the non-selection period (S2=L) of the common signal COM1 comes, the transmission gate 33 is turned off and the transmission gate 34 on, and the potential of the common signal COM1 is at the intermediate potential V2.

When the clock signal S1 becomes low level, the transistor 11 is turned off and the transistor 12 on, and the potential of the power supply potential signal V03CM outputted from the power-supply potential selection circuit 10 is at the power supply potential VSS. Moreover, the transmission gate 21 is turned on and the transmission gate 22 off, and the potential of the intermediate potential signal V12CM outputted from the intermediate potential selection circuit 20 is at the intermediate potential V1.

And in this case, when the selection period of the common signal COM1 comes, the transmission gate 33 is turned on and the transmission gate 34 off, and the potential of the common signal COM1 outputted from the output selection circuit 30 is at the power supply potential VSS. On the other hand, when the non-selection period of the common signal COM1 comes, the transmission gate 33 is turned off, the transmission gate 34 on, and the potential of the common signal COM1 is at the intermediate potential V1.

Here, the edge detection signal S4 is a signal indicating the two edges (rising edge and falling edge) of the clock signals S1 and S2 corresponding to the timings at which the potential of the common signal COM1 switches, and stays at low level only during a predetermined period T2 (second period) from these edges. Therefore, the transmission gates 31 and 32 are both turned off only for the period T2 from when the potential of the common signal COM1 is switched and are on/off controlled during the other periods, similar to the case with transmission gates 33 and 34, respectively.

Moreover, as described above, the transmission gates 31 and 33 are connected in parallel, and the size of the transistor constituting the transmission gate 31 is larger than the size of the transistor constituting the transmission gate 33. Further, the transmission gates 32 and 34 are connected in parallel, and the size of the transistor constituting the transmission gate 32 is larger than the size of the transistor constituting the transmission gate 34. Therefore, the output impedance of the output selection circuit 30 stays at a high state only for the period T2 from when the potential of the common signal COM1 is switched, and the impedance of the common signal COM1 outputted from the common signal output circuit 1 increases to, for example, several tens of times.

Figure 13:
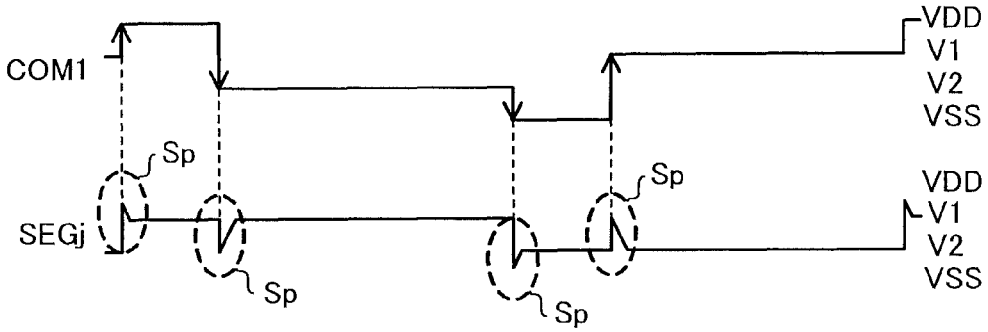
FIG. 13 is a diagram for explaining an operation of a liquid crystal driving circuit illustrated in FIG. 12.

As described above, the common signal output circuit 1 lowers the through rate only for the period T2 when the potential of the common signal COM1 is switched. Therefore, similar to FIG. 13, even in the case where the potential of the common signal COM1 is switched while the potential of the segment signal SEGj is at an intermediate potential, the size and convergence time of the spike noise Sp generated in the segment signal SEGj can be reduced as illustrated in FIG. 3. Thus, the amount of current consumed and the mounting area of the circuit board can be suppressed while ensuring a favorable display quality.

Subsequently, an operation of the segment-signal output circuit 4 will be described.

The potential of the segment signal (SEGj, SEGj') outputted from the segment-signal output circuit 4 is selected in accordance with the clock signals S1 and S3.

Among the four segments corresponding to the segment signal (SEGj, SEGj'), the high-level period of the clock signal S3 indicates the selection period of the common signal COMi corresponding to a segment to be turned on. As described above, since the four segments corresponding to the segment signal SEGj are all turned off, the clock signal S3 becomes low level at all the selection periods of the common signals COM1 to COM4 as illustrated in FIG. 3. On the other hand, among the four segments corresponding to the segment signal SEGj', the two segments corresponding to the common signals COM1 and COM3 are turned on and thus, the clock signal S3 becomes high level during the selection period of the common signals COM1 and COM3 as illustrated in FIG. 4.

When the clock signal S1 becomes high level, the transistor 41 is turned off and the transistor 42 on, and the potential of the power supply potential signal V03SG outputted from the power-supply potential selection circuit 40 is at the power supply potential VSS. Moreover, the transmission gate 51 is turned on and the transmission gate 52 off, and the potential of the intermediate potential signal V12SG outputted from the intermediate potential selection circuit 50 is at the intermediate potential V1.

Then, in this case, when the clock signal S3 becomes high level, the transmission gate 63 is turned on and the transmission gate 64 off, and the potential of the segment signal (SEGj, SEGj') outputted from the output selection circuit 60 is at the power supply potential VSS. On the other hand, when the clock signal S3 becomes low level, the transmission gate 63 is turned off, the transmission gate 64 is turned on, and the potential of the segment signal (SEGj, SEGj') is at the intermediate potential V1.

When the clock signal S1 becomes low level, the transistor 41 is turned on and the transistor 42 off, and the potential of the power supply potential signal V03SG outputted from the power-supply potential selection circuit 40 is at the power supply potential VDD. Moreover, the transmission gate 51 is turned off and the transmission gate 52 on, and the potential of the intermediate potential signal V12SG outputted from the intermediate potential selection circuit 50 is at the intermediate potential V2.

Then, in this case, when the clock signal S3 becomes high level, the transmission gate 63 is turned on and the transmission gate 64 off, and the potential of the segment signal (SEGj, SEGj') outputted from the output selection circuit 60 is at the power supply potential VDD. On the other hand, when the clock signal S3 becomes low level, the transmission gate 63 is turned off and the transmission gate 64 on, and the potential of the segment signal (SEGj, SEGj') is at the intermediate potential V2.

Here, the edge detection signal S5 is a signal indicating the two edges (rising edge and falling edge) of the clock signals S1 and S3 corresponding to the timing at which the potential of the segment signal (SEGj, SEGj') switches, and stays at low level only during a predetermined period T1 (first period) from these edges. Therefore, the transmission gates 61 and 62 are both turned off only during the period T1 from when the potential of the segment signal (SEGj, SEGj') is switched and are on/off controlled during the other periods, similar to the case with the transmission gates 63 and 64, respectively. In FIGS. 3 and 4, the case assuming T1=T2 is illustrated as an example.

Moreover, as described above, the transmission gates 61 and 63 are connected in parallel, and the size of the transistor constituting the transmission gate 61 is larger than the size of the transistor constituting the transmission gate 63. Moreover, the transmission gates 62 and 64 are connected in parallel, and the size of the transistor constituting the transmission gate 62 is larger than the size of the transistor constituting the transmission gate 64. Therefore, the output impedance of the output selection circuit 60 stays at a high state only for the period T1 from when the potential of the segment signal (SEGj, SEGj') is switched, and the impedance of the segment signal (SEGj, SEGj') outputted from the segment signal output circuit 4 increases to, for example, several tens of times.

Figure 14:
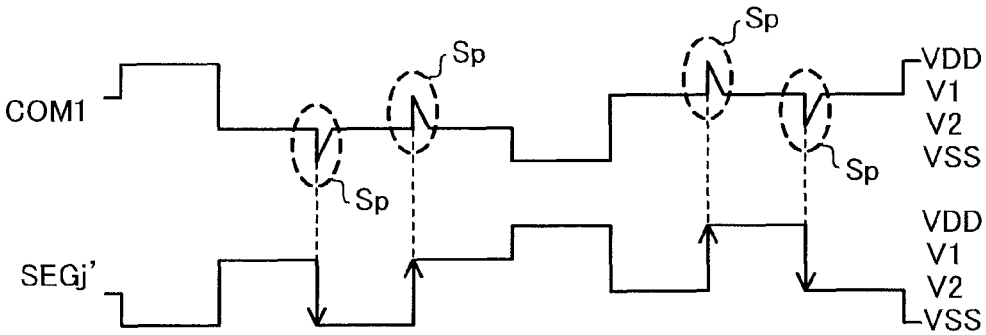
FIG. 14 is a diagram for explaining an operation of a liquid crystal driving circuit illustrated in FIG. 12.

As described above, the segment signal output circuit 4 lowers the through rate only for the period T1 when the potential of the segment signal (SEGj, SEGj') is switched. Therefore, similar to FIG. 14, even in the case where the potential of the segment signal SEGj' is switched while the potential of the common signal COM1 is at an intermediate potential, the size and convergence time of the spike noise Sp generated in the common signal COM1 can be reduced as illustrated in FIG. 4. Thus, the amount of current consumed and the mounting area of the circuit board can be suppressed at the same time while ensuring a favorable display quality.

Other Configuration Examples of Output Selection Circuit

In the above-described embodiment, the output selection circuit 30 (60) changes the output impedance by using the transmission gates with different transistor sizes, but it is not limited thereto. For example, the output impedance of the output selection circuit 30 (60) may be raised to a high state by setting the gate voltage of the transistor constituting the transmission gate to an intermediate voltage for period T2 (T1).

In the above-described embodiment, T1 was set to equal T2 as an example, but it is not limited thereto. The output selection circuit 30 (60) may individually set the length of the periods T1 and T2 or may be configured such that the length of the periods T1 and T2 are made changeable in accordance with a setting value stored in a setting register (not shown).

In the above-described embodiment, the transmission gates 31 and 32 (61 and 62) are both controlled to be turned off during period T2 (T1) and the transmission gates 33 and 34 (63 and 64) are controlled such that either one of them is turned on all the time, but it is not limited thereto. The output selection circuit 30 (60) may be configured such that the transmission gates 33 and 34 (63 and 64) are both turned off during periods besides period T2 (T1), for example.

Figure 5:
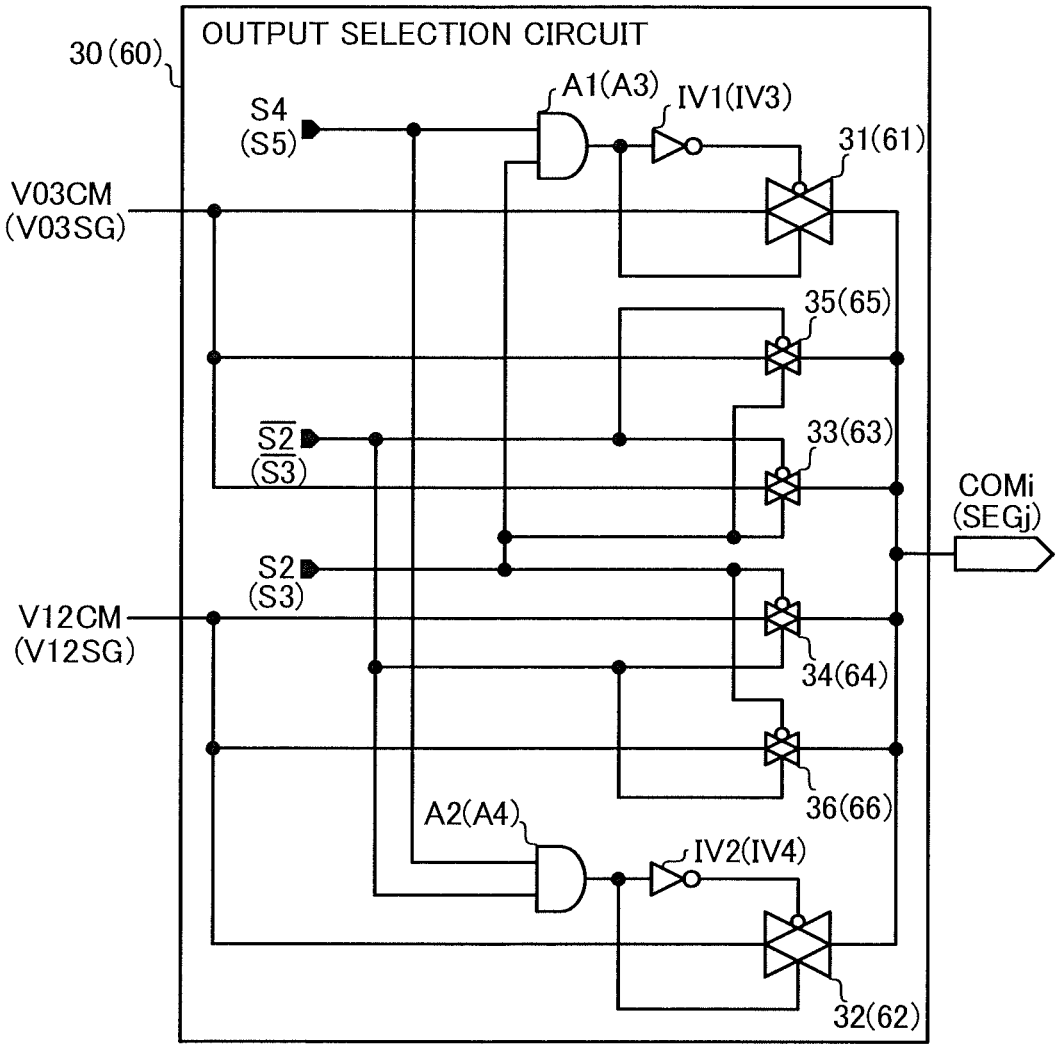
FIG. 5 is a circuit block diagram illustrating another configuration example of an output selection circuit.
Figure 6:
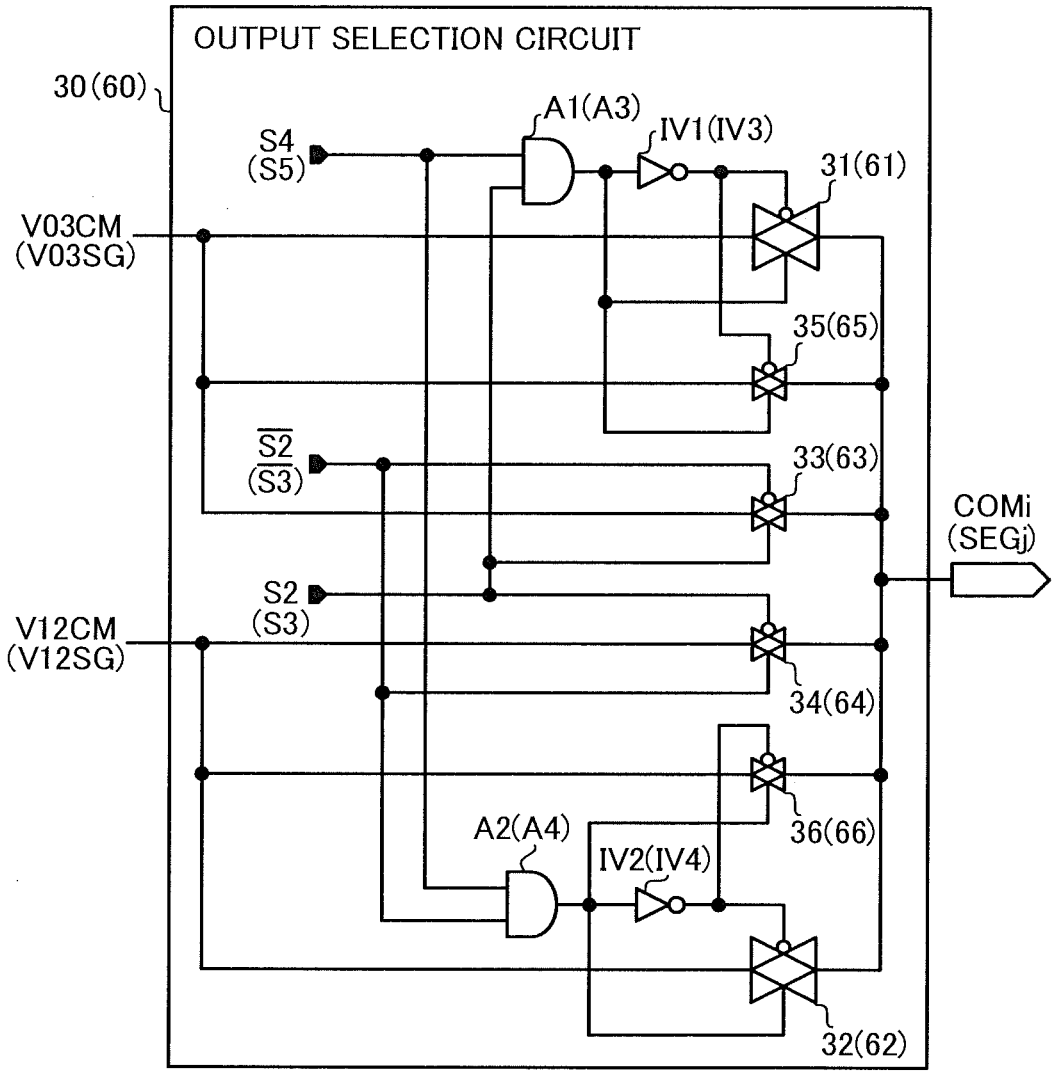
FIG. 6 is a circuit block diagram illustrating another configuration example of an output selection circuit.

In the above-described embodiment, the output impedance ratio of the output selection circuit 30 (60) during period T2 (T1) and periods besides this are determined in advance by the size of the transistor constituting the transmission gates 31 to 34 (61 to 64), but it is not limited thereto. The output selection circuit 30 (60) may be configured to further include the transmission gates 35 and 36 (65 and 66) and to be able to change a control signal for controlling the gates to be turned on/off as illustrated in FIGS. 5 and 6, for example. Note that, the transmission gates 35 and 36 correspond to a fifth switch circuit and the transmission gates 65 and 66 correspond to a sixth switch circuit.

In FIGS. 5 and 6, the transmission gate 35 (65) is connected in parallel with the transmission gates 31 and 33 (61 and 63), while the transmission gate 36 (66) is connected in parallel with the transmission gates 32 and 34 (62 and 64). Here, assuming that the output impedance of a transmission gate x is expressed as Zx, $Z31=Z32 \ll Z33=Z34 \leq Z35=Z36$ ($Z61=Z62 \ll Z63=Z64 \leq Z65=Z66$) is obtained as an example.

In FIG. 5, the transmission gates 35 and 36 (65 and 66) are set to be controlled on/off in synchronization with the transmission gates 33 and 34 (63 and 64), respectively. On the other hand, in FIG. 6, the transmission gates 35 and 36 (65 and 66) are set to be controlled on/off in synchronization with the transmission gates 31 and 32 (61 and 62), respectively. Note that, the transmission gates 35 and 36 (65 and 66) can be further set to off permanently.

As described above, the output selection circuit 30 (60) being configured to be able to change the control signal of the transmission gates 35 and 36 (65 and 66) allows the output impedance ratio of the output selection circuit 30 (60) during period T2 (T1) and the periods besides this to be changed. Note that, the control signal of the transmission gates 35 and 36 (65 and 66) can be changed in accordance with a setting value stored in the setting register (not shown) or can be changed by switching the wiring by means of such as mask change or laser repair.

If the output impedance ratio is small, the spike noise Sp cannot be sufficiently suppressed, which may cause an image to remain. On the other hand, if the output impedance ratio is large, time until the potentials of the common signal COMi and the segment signal SEGj are fully switched is prolonged, which may cause flickering or the like. Therefore, an adjustment can be made so as to obtain optimal display quality by actually connecting the liquid crystal panel 9 and changing the output impedance ratio while checking the display status.

Other Driving Methods of Liquid Crystal Driving Circuit

In the above-described embodiment, description was given of the liquid crystal driving circuit performing ⅓ bias driving as the driving method but it is not limited thereto.

Figure 7:
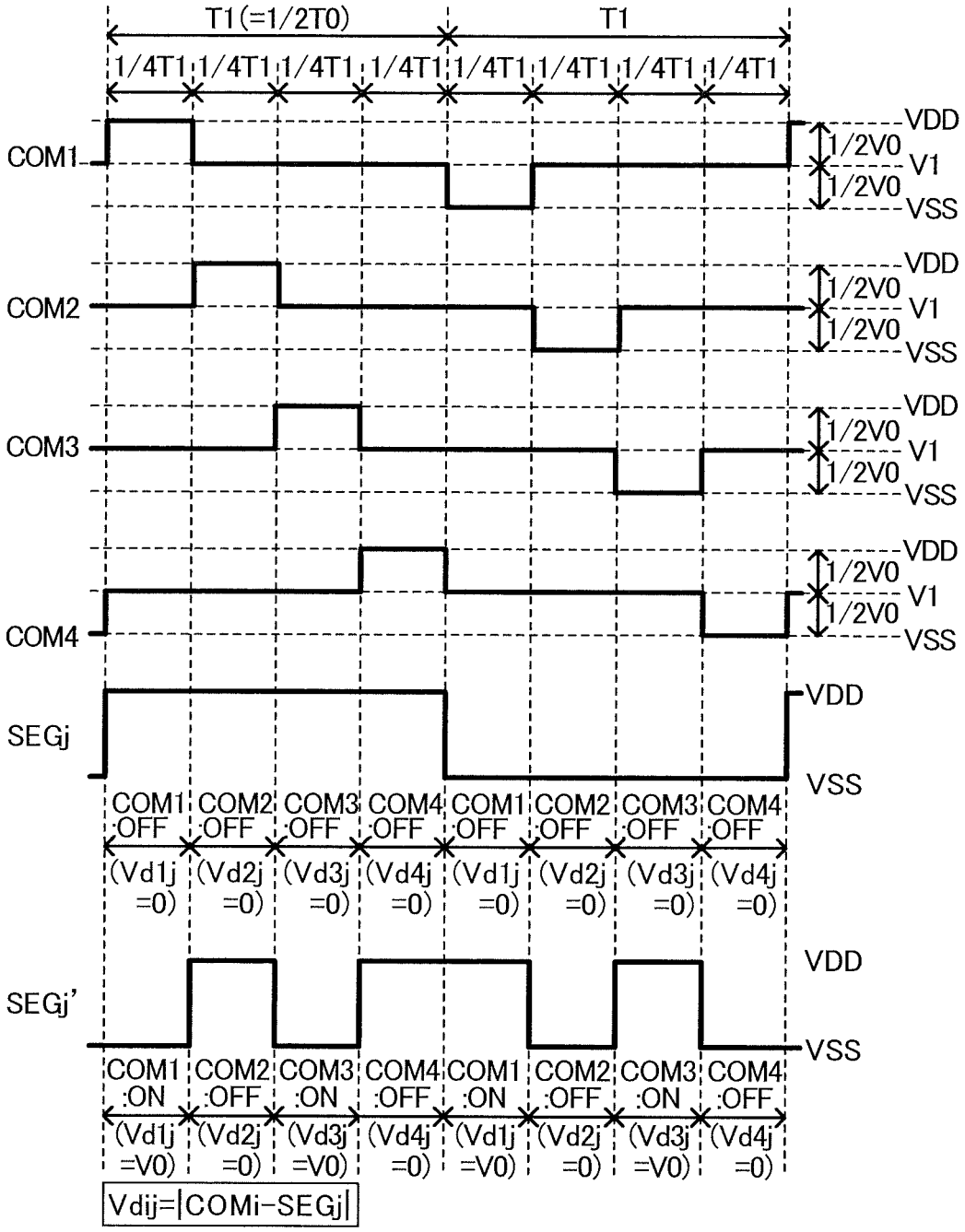
FIG. 7 is a diagram illustrating another example of a driving method of a liquid crystal driving circuit.
Figure 8:
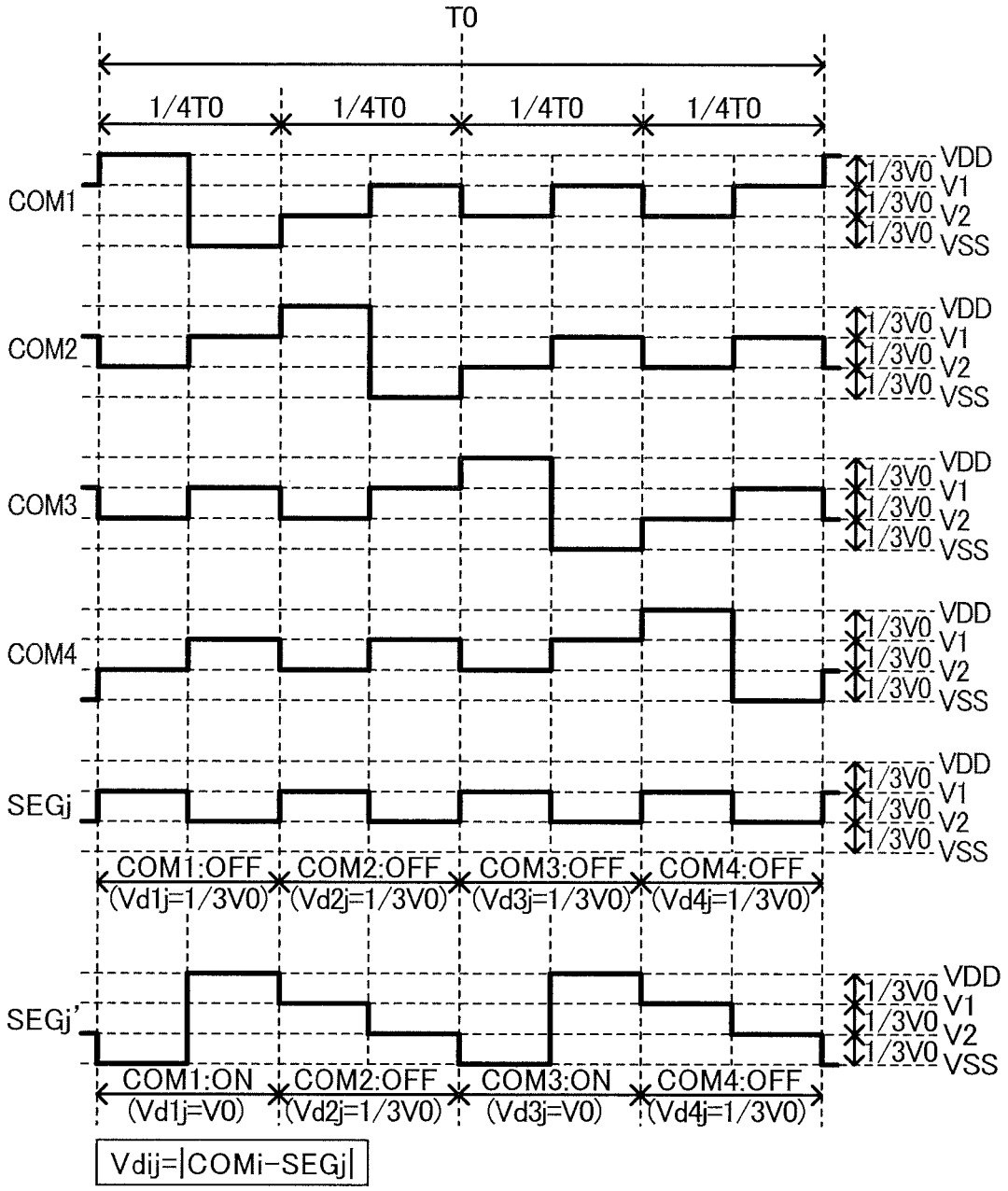
FIG. 8 is a diagram illustrating still another example of a driving method of a liquid crystal driving circuit.
Figure 9:
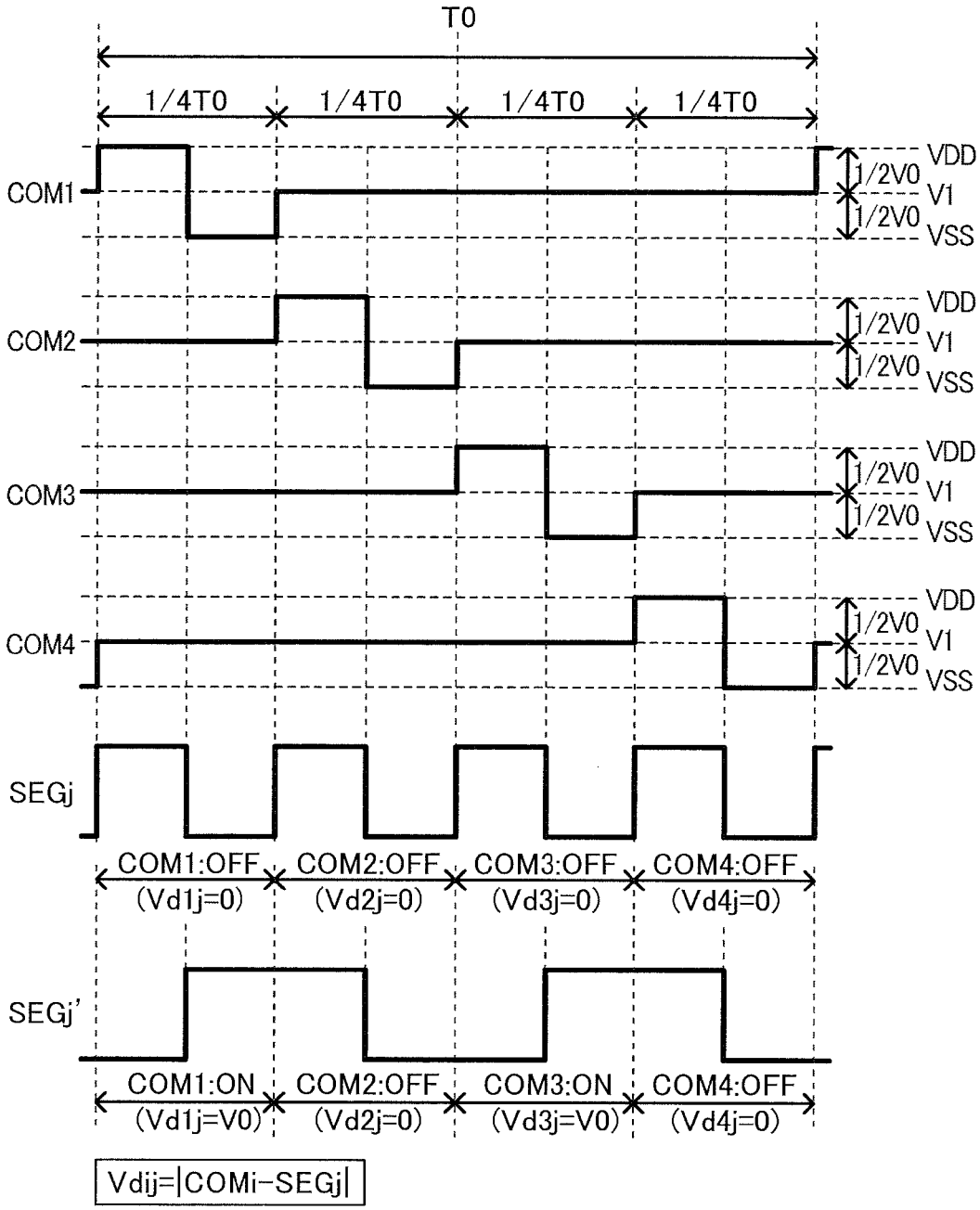
FIG. 9 is a diagram illustrating still another example of a driving method of a liquid crystal driving circuit.
Figure 10:
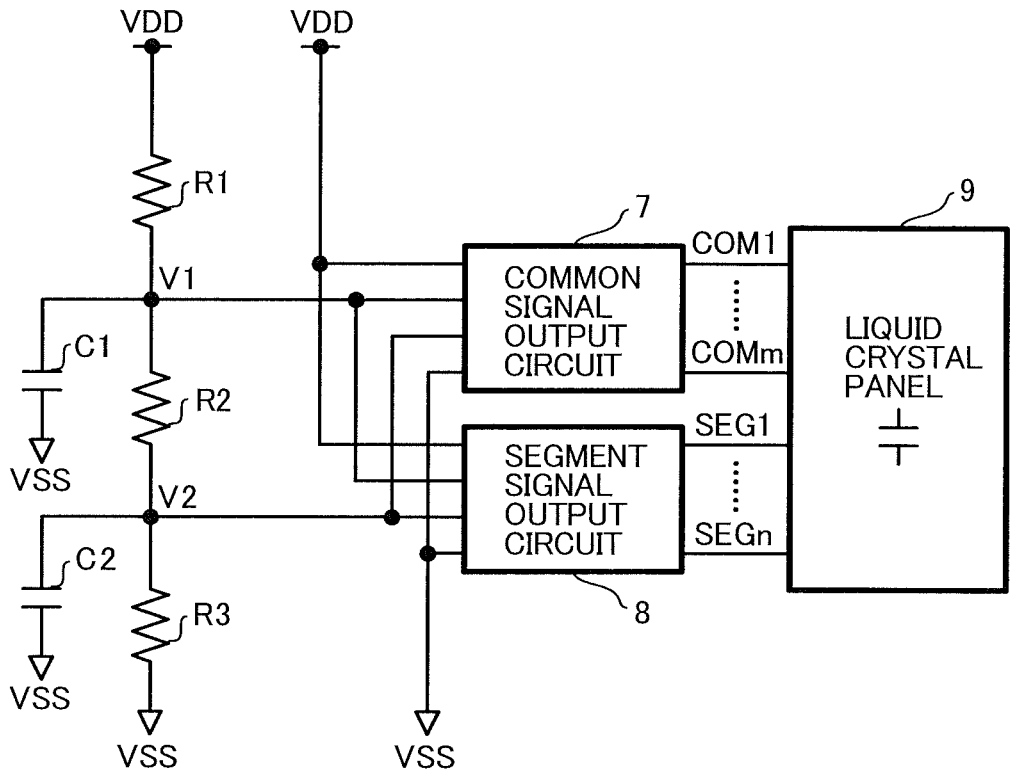
FIG. 10 is a circuit block diagram illustrating an example of a configuration of a general liquid crystal driving circuit provided with an external capacitor.
Figure 11:
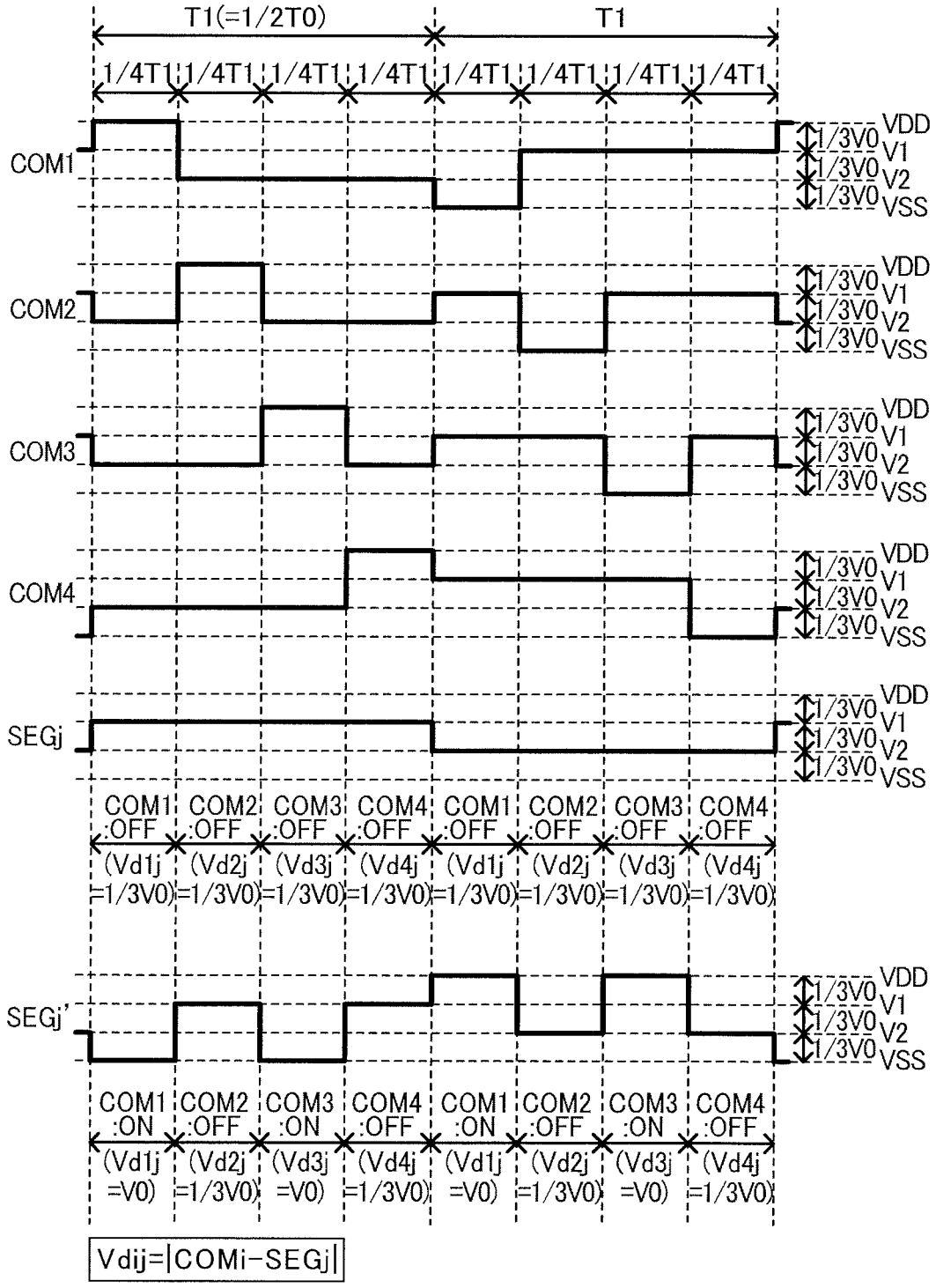
FIG. 11 is a diagram for explaining an operation of a liquid crystal driving circuit illustrated in FIG. 10.
Figure 12:
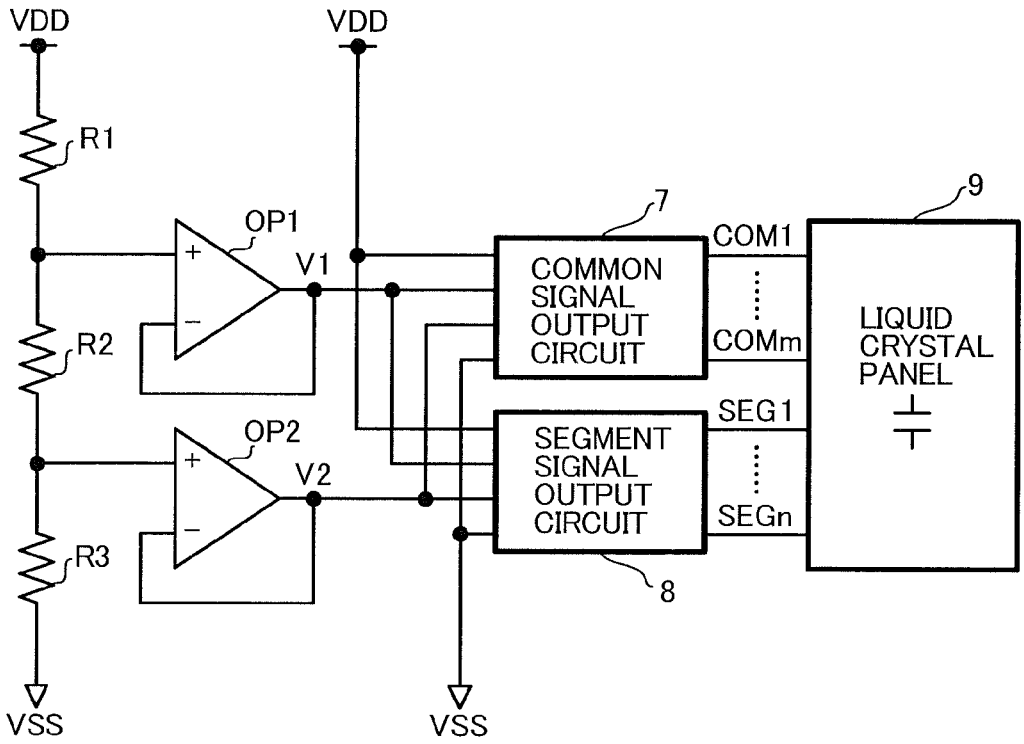
FIG. 12 is a circuit block diagram illustrating an example of a configuration of a general liquid crystal driving circuit provided with a voltage follower circuit.

FIG. 7 illustrates an operation of a liquid crystal driving circuit configured to perform ½ bias driving. As illustrated in FIG. 7, in the ½ bias driving method, the segment signal (SEGj, SEG') is not at the intermediate potential V1 but at only the power supply potential VDD or VSS which is sufficiently stable as compared with the intermediate potential V1. Therefore, in this driving method, it is only necessary that only the impedance of the segment signal (SEGj, SEGj') is increased thereby suppressing the spike noises generated in the common signal COMi. Moreover, the ⅓ bias and ½ bias driving method illustrated in FIGS. 8 and 9, respectively, are also generally known.

As described above, when the potential of the segment signal SEGj is switched in the liquid crystal driving circuit including the segment signal output circuit 4 illustrated in FIG. 1, the through rate can be lowered only for period T1 to suppress the spike noise Sp generated in the common signal COMi by increasing the impedance of the segment signal SEGj only for the period T1, so that favorable display quality can be ensured while the amount of current consumption and mounting area on the circuit board can be suppressed at the same time.

Moreover, when the potential of the common signal COMi is switched in the liquid crystal driving circuit further including the common signal output circuit 1 illustrated in FIG. 1, the through rate can be lowered only for period T2 to suppress the spike noise Sp generated in the segment signal SEGj by increasing the impedance of the common signal COMi only for the period T2.

Also, turning off the switch circuit with the lower output impedance only for period T2 (T1) by use of switch circuits with different output impedances connected in parallel allows the output selection circuit 30 (60) to lower the through rate of the common signal COMi (segment signal SEGj) only for the period T2 (T1).

Moreover, turning off the transmission gate with a larger transistor size only for period T2 (T1) by use of transmission gates with different transistor sizes allows the output impedance of the output selection circuit 30 (60) to be maintained at a high state only for the period T2 (T1).

Moreover, by configuring the output selection circuit 30 (60) to further include the transmission gates 35 and 36 (65 and 66) which are on/off controlled in synchronization with the transmission gates 31 and 32 (61 and 62), respectively, or capable of being set to be on/off controlled in synchronization with the transmission gates 33 and 34 (63 and 64), respectively, allows the output impedance ratio during period T2 (T1) and the periods besides this to be changed so that the liquid crystal panel 9 can be adjusted to optimal display quality.

The above embodiments of the present invention are simply for facilitating the understanding of the present invention and are not in any way to be construed as limiting the present invention. The present invention may variously be changed or altered without departing from its spirit and encompass equivalents thereof.

What is claimed is:

1. A liquid crystal driving circuit, comprising:

a common-signal output circuit configured to supply common signals to common electrodes of a liquid crystal panel and configured to have one or more common nodes whose impedances can be changed, each of the common signals being at a first potential, a second potential, or one or more intermediate potentials in a predetermined order, wherein the common-signal output circuit includes first and second switch circuits each configured to output the common signals being at a potential selected from the first potential, the second potential, or the one or more intermediate potentials;

the first and second switch circuits are connected in parallel;

an output impedance of the first switch circuit is lower than an output impedance of the second switch circuit;

a segment-signal output circuit configured to supply segment signals to segment electrodes of the liquid crystal panel and configured to have one or more segment nodes whose impedances can be changed and configured, each of the segment signals being at the first potential, the second potential, or the one or more intermediate potentials in accordance with the common signals, wherein the segment-signal output circuit includes third and fourth switch circuits each configured to output the segment signals being at a potential selected from the first potential, the second potential, or the one or more intermediate potentials;

the third and fourth switch circuits are connected in parallel;

an output impedance of the third switch circuit is lower than an output impedance of the fourth switch circuit; wherein the common-signal output circuit and the segment-signal output circuit are further configured to increase impedances of the common node and the segment node, respectively, in response to first and second edge detection signals, respectively, and wherein the common-signal output circuit is further configured to increase impedances of the common nodes in response to falling edges of the first edge detection signal.

2. The liquid crystal driving circuit according to claim 1, wherein the first to fourth switch circuits are composed of first to fourth transmission gates, respectively;

a size of a transistor constituting the first transmission gate is larger than a size of a transistor constituting the second transmission gate; and a size of a transistor constituting the third transmission gate is larger than a size of a transistor constituting the fourth transmission gate.

3. The liquid crystal driving circuit according to claim 1, wherein the common-signal output circuit further includes a fifth switch circuit configured to have an output impedance higher than the output impedance of the first switch circuit but not higher than the output impedance of the second switch circuit;

the fifth switch circuit can be set to be on/off controlled in synchronization with the first switch circuit or to be on/off controlled in synchronization with the second switch circuit;

the segment-signal output circuit further includes a sixth switch circuit configured to have an output impedance higher than the output impedance of the third switch circuit but not higher than the output impedance of the fourth switch circuit; and the sixth switch circuit can be set to be on/off controlled in synchronization with the third switch circuit or to be on/off controlled in synchronization with the fourth switch circuit.

4. The liquid crystal driving circuit according to claim 2, wherein the common-signal output circuit further includes a fifth switch circuit configured to have an output impedance higher than the output impedance of the first switch circuit but not higher than the output impedance of the second switch circuit;

the first switch circuit can be set to be on/off controlled in synchronization with the first switch circuit or to be on/off controlled in synchronization with the second switch circuit;

the segment-signal output circuit further includes a sixth switch circuit configured to have an output impedance higher than the output impedance of the third switch circuit but not higher than the output impedance of the fourth switch circuit; and the sixth switch circuit can be set to be on/off controlled in synchronization with the third switch circuit or to be on/off controlled in synchronization with the fourth switch circuit.

5. A method for driving a liquid crystal panel, comprising:

providing a first signal at a first node and a second signal at a second node in response to a first clock signal;

configuring a third node to be in a high impedance state in response to a first edge detection signal;

changing a voltage level of a first drive signal at the third node in response to the first edge detection signal being in a first logic state; and changing a voltage level of a second drive signal at a fourth node in response to a second edge detection signal being in a first logic state, wherein the high impedance state mitigates a transient signal of the second drive signal.

6. The method of claim 5, further including providing a third signal at the first node and a fourth signal at the second node in response to a complementary first clock signal.

7. The method of claim 6, wherein the first clock signal is at a first logic level and the complementary clock signal is at a second logic level that is a complement of the first logic level.

8. The method of claim 6, wherein providing the first signal at the first node includes providing the first signal as a first operating potential and providing the second signal at the second node in response to a first clock signal includes providing the second signal as a voltage having a first value that is intermediate between the first operating potential and a second operating potential.

9. The method of claim 8, wherein providing the third signal at the first node includes providing the third signal as a second operating potential and providing the fourth signal at the second node in response to the complementary first clock signal includes providing the fourth signal as a voltage having a second value that is intermediate between the first operating potential and a second operating potential.

10. The method of claim 8, wherein changing the voltage level of the first drive signal at the third node in response to the first edge detection signal being in the first logic state includes placing one of the signal at the first operating potential, the signal at the second operating potential, the first value that is intermediate between the first operating potential and the second operating potential, or the second value that is intermediate between the first operating potential and the second operating potential on the third node.

11. The method of claim 10, wherein changing a voltage level of the second drive signal at the fourth node in response to the second edge detection signal being in the first logic state includes placing one of the signal at the first operating potential, the signal at the second operating potential, the first value that is intermediate between the first operating potential and the second operating potential, or the second value that is intermediate between the first operating potential and the second operating potential on the fourth node.

12. The method of claim 5, further including:

providing a third signal at a second node and a fourth signal at a fifth node in response to a complementary first clock signal; and configuring the fourth node to be in a high impedance state in response to a first edge detection signal.

13. The method 12, further including configuring the fourth node to be in a high impedance state and the third node to be in a low impedance state.

14. A method for driving a liquid crystal panel, comprising:

providing a drive circuit having at least first and second output nodes; and configuring the first output node to be in a high impedance state and the second output node to be in a low impedance state in response to first and second edge detection signals, respectively, wherein configuring the first output node to be in the high impedance state comprises opening a first transmission gate that is in parallel with a second transmission gate.

15. The method of claim 14, wherein configuring the second output node to be in a high impedance state comprising opening a third transmission gate that is in parallel with a fourth transmission gate.

16. The method of claim 15, further including configuring the first and second transmission gates to be in the high impedance state at the same time.

17. The method of claim 15, further including configuring the second transmission gate to be in the high impedance state and the first transmission gate to be in the low impedance state.

* * * * *